US012668965B1

(12) United States Patent
Murray

(10) Patent No.: US 12,668,965 B1
(45) Date of Patent: Jun. 30, 2026

(54) PERGOLA CORNER BRACKET ASSEMBLY

(71) Applicant: Michael Murray, Jacksonville, FL (US)

(72) Inventor: Michael Murray, Jacksonville, FL (US)

( * ) Notice: Subject to any disclaimer, the term of this patent is extended or adjusted under 35 U.S.C. 154(b) by 0 days.

(21) Appl. No.: 19/321,554

(22) Filed: Sep. 8, 2025

(51) Int. Cl.
*E04B 1/18* (2006.01)

(52) U.S. Cl.
CPC ..... *E04B 1/185* (2013.01)

(58) Field of Classification Search
CPC ..... E04B 1/185; E04B 1/1903; E04B 1/5831; E04B 2001/1933; E04B 2001/1918; E04B 2001/1921; E04B 2001/1963; E04B 2001/2644; E04B 2001/2451; Y10T 403/44
See application file for complete search history.

(56) References Cited

U.S. PATENT DOCUMENTS 4,299,509 A * 11/1981 Meickl ..... E04B 1/58 403/174
4,863,305 A * 9/1989 Schold ..... E04B 1/2604 403/171
5,617,694 A * 4/1997 Baba ..... E04B 1/2604 403/174
5,680,737 A * 10/1997 Sheipline ..... F16B 7/0453 403/205
9,057,190 B1 * 6/2015 Winter ..... E04F 15/04
10,738,457 B1 * 8/2020 Hendry ..... E04B 1/1903
11,230,838 B1 * 1/2022 Mendez-Vazquez ... E04B 1/388
11,332,920 B2 * 5/2022 Houghton ..... E04B 1/30
11,828,056 B2 * 11/2023 Styrc ..... E04B 1/2608
2013/0326993 A1 * 12/2013 Schold ..... E04B 1/185 52/655.1
2019/0161956 A1 * 5/2019 Houghton ..... E04B 1/2403

FOREIGN PATENT DOCUMENTS

GB 2036235 A * 6/1980 ..... E04B 1/5831

* cited by examiner

*Primary Examiner* — Christine T Cajilig
(74) *Attorney, Agent, or Firm* — Ashkan Najafi

(57) ABSTRACT

A pergola corner bracket assembly including a bracket having a first flange and a second flange registered orthogonal thereto, and a third flange and a fourth flange registered orthogonal thereto. The first flange, the second flange, the third flange, and the fourth flange are arranged in an X-shaped configuration. The X-shaped configuration has a longitudinal axis aligned parallel to a shared corner of the first flange and the second flange. Each of the third flange and the fourth flange are disposed next to the shared corner.

27 Claims, 6 Drawing Sheets

PERGOLA CORNER BRACKET ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to pergolas and, more particularly, to a pergola corner bracket assembly configured to: be self-aligning; reduce and hide requisite fasteners; enable wire chases through the pergola beams; and allow the pergola columns to be internally plumbed for water drainage.

Prior Art

A framework used in a pergola-type protection installation comprises several metal sections assembled together. The frame generally comprises several posts resting against the ground and supporting at each corner a rectangular upper frame formed of several sections. At the top of each post, the frame comprises a corner piece fixed to said post located below and providing the junction at right angles to two adjacent sections of the frame. A roll-up canvas or retractable slats are mounted on said frame and can be ordered to provide a function of protection against the sun or against the weather. Notably, on most conventional pergolas, the beam is attached to the side of a column or to a bracket sitting on top of the column (e.g., the bracket is not set within the column).

In the pergola frame, each corner piece has a strategic position because it is fixed at the top of a post and supports two frame sections. It must thus: be easy to mount and fix on its reception post; be equipped with assembly means to easily receive the two frame sections and fix these two sections; have suitable mechanical characteristics to ensure the support of the frame; and possibly be equipped with certain functions such as the drainage of rainwater and the filtration of this water.

Accordingly, a need remains for a specially configured pergola corner bracket assembly to overcome at least one aforementioned shortcoming. The exemplary embodiment (s) satisfy such a need by providing a pergola corner bracket assembly that is convenient and easy to use, durable in design, versatile in its applications, and configured to: be self-aligning; reduce and hide requisite fasteners; enable wire chases through the pergola beams; and allow the pergola columns to be internally plumbed for water drainage.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a pergola corner bracket assembly configured to: be self-aligning; reduce and hide requisite fasteners; enable wire chases through the pergola beams; and allow the pergola columns to be internally plumbed for water drainage. These and other objects, features, and advantages of the non-limiting exemplary embodiment(s) are provided by a pergola corner bracket assembly including a bracket having a first flange and a second flange registered orthogonal thereto, and a third flange and a fourth flange registered orthogonal thereto. Advantageously, the first flange, the second flange, the third flange, and the fourth flange are arranged in a X-shaped configuration. The X-shaped configuration has a longitudinal axis aligned parallel to a shared corner of the first flange and the second flange. Notably, each of the third flange and the fourth flange are disposed next to the shared corner.

In a non-limiting exemplary embodiment, the X-shaped configuration includes two axes of asymmetry including a horizontal axis aligned along and parallel to the first flange and the third flange. A vertical axis is aligned along and parallel to the second flange and the fourth flange. Advantageously, the vertical axis passes through a centrally offset point of the horizontal axis.

In a non-limiting exemplary embodiment, the X-shaped configuration includes a first V-shaped portion and a second V-shaped portion being unequal thereto. Advantageously, the first V-shaped portion and the second V-shaped portion each have an associated apex disposed at the shared corner.

In a non-limiting exemplary embodiment, the pergola corner bracket assembly further includes a plurality of fasteners affixed to the bracket. Such a bracket further has a plurality of holes configured to receive therethrough selected ones of the fasteners. Advantageously, such fasteners are not visible from an external line of sight of the pergola corner bracket assembly.

In a non-limiting exemplary embodiment, the bracket further has two pairs of opposing angles that are substantially equal.

In a non-limiting exemplary embodiment, a center of the X-shaped configuration is located at the shared corner of the first flange and the second flange. Such a longitudinal axis is aligned parallel to associated medial longitudinal edges of the third flange and the fourth flange, respectively.

In a non-limiting exemplary embodiment, the first flange has a first latitudinal width and a first longitudinal length substantially equal to a second latitudinal width and a second longitudinal length of the second flange.

In a non-limiting exemplary embodiment, the third flange has a third latitudinal width and a third longitudinal length substantially equal to a fourth latitudinal width and a fourth longitudinal length of the fourth flange.

In a non-limiting exemplary embodiment, the first flange is coextensively shaped to the second flange.

In a non-limiting exemplary embodiment, the third flange is coextensively shaped to the fourth flange.

In a non-limiting exemplary embodiment, each of the first flange, the second flange, the third flange, and the fourth flange has a substantially equal longitudinal length.

In a non-limiting exemplary embodiment, each of the first flange, the second flange, the third flange, and the fourth flange has a single and unitary layer provided with a planar anterior side and a planar posterior side, respectively.

In a non-limiting exemplary embodiment, the pergola corner bracket assembly further includes a column including four sides arranged to have a generally square cross-sectional shape. Each of the first flange and the third flange is oriented substantially parallel to a first one and a second one of the four sides as well as oriented substantially perpendicular to a third one and a fourth one of the four sides.

In a non-limiting exemplary embodiment, the pergola corner bracket assembly further includes a column having a plurality of interior walls. Advantageously, the bracket is fastened to the interior walls within the column. Advantageously, the bracket is configured such that the first flange, the second flange, the third flange, and the fourth flange bear most of a structural load of the pergola corner bracket assembly.

In a non-limiting exemplary embodiment, the pergola corner bracket assembly further includes a column attached to the bracket, and a plurality of beams attached to the column and the bracket.

In a non-limiting exemplary embodiment, the bracket is configured to self-align the beams on the column.

In a non-limiting exemplary embodiment, each of the beams has a hollow interior cavity. Advantageously, the bracket further includes a plurality of apertures located at the third flange and the fourth flange, respectively. Such apertures are in open communication with the hollow interior cavity and configured to use the beams to as wire chases and further configured to internally plumb the column for water drainage.

In a non-limiting exemplary embodiment, a load of each of the beams sits on top of the column. In this manner, the bracket is configured to distribute the load directly and solely to the column and the fasteners. Advantageously, the bracket is further configured to enable larger pergola spatial dimensions without requiring additional ones of the column.

In a non-limiting exemplary embodiment, the pergola corner bracket assembly further includes a corner end cap affixed to the third flange and the fourth flange while remaining spaced from the first flange and the second flange.

In a non-limiting exemplary embodiment, a first rectilinear hypotenuse distance between a first outer longitudinal edge of the first flange and a second outer longitudinal edge of the second flange is greater than a second rectilinear hypotenuse distance between a third outer longitudinal edge of the third flange and a fourth outer longitudinal edge of the fourth flange.

There has thus been outlined, rather broadly, the more important features of non-limiting exemplary embodiment (s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
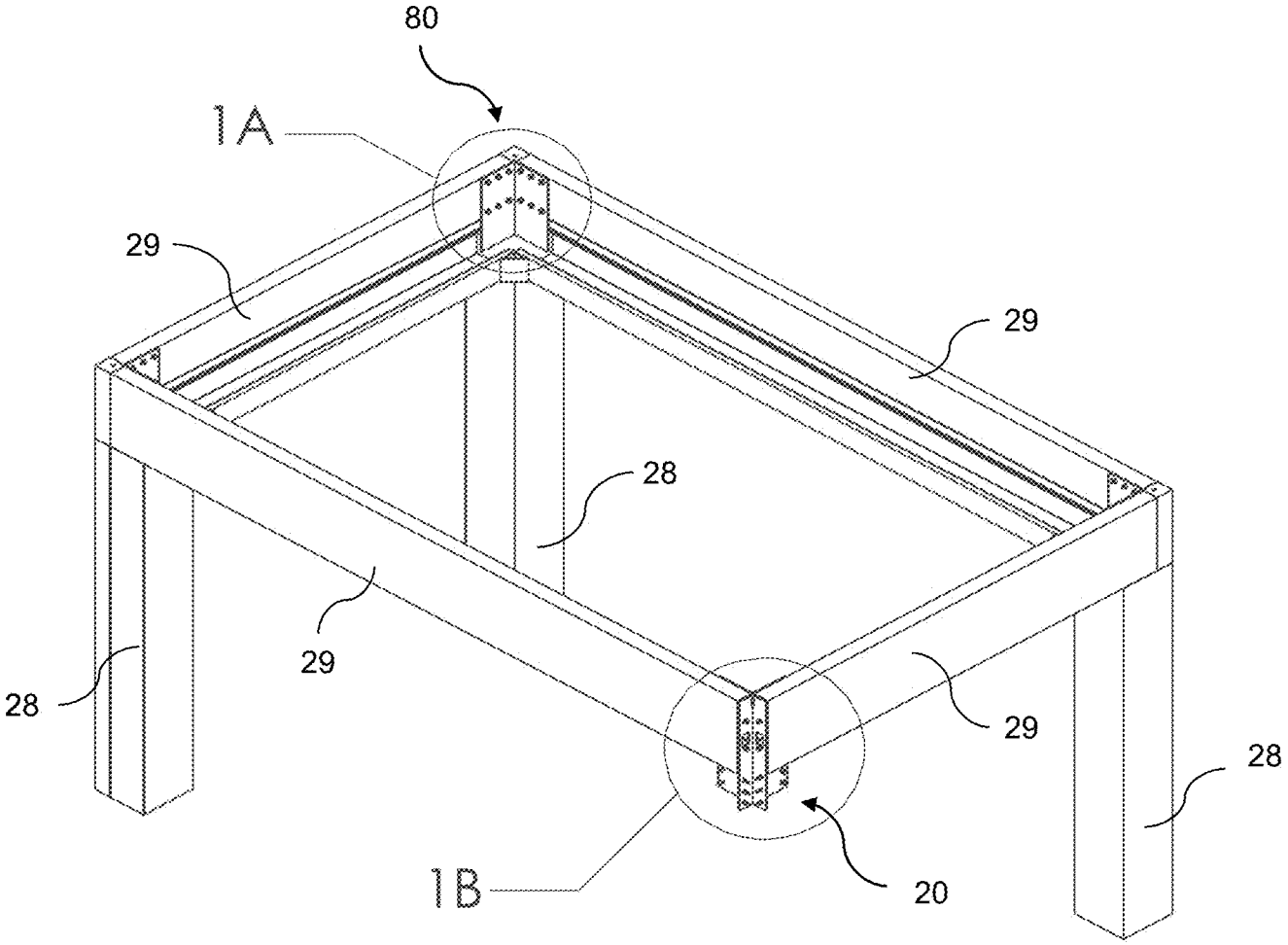
FIG. 1 is a perspective of a partial pergola having pergola corner bracket assemblies wherein one of the columns and associated corner cap is removed to show the structural relationship between the bracket and the beams, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment (s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

Figure 2:
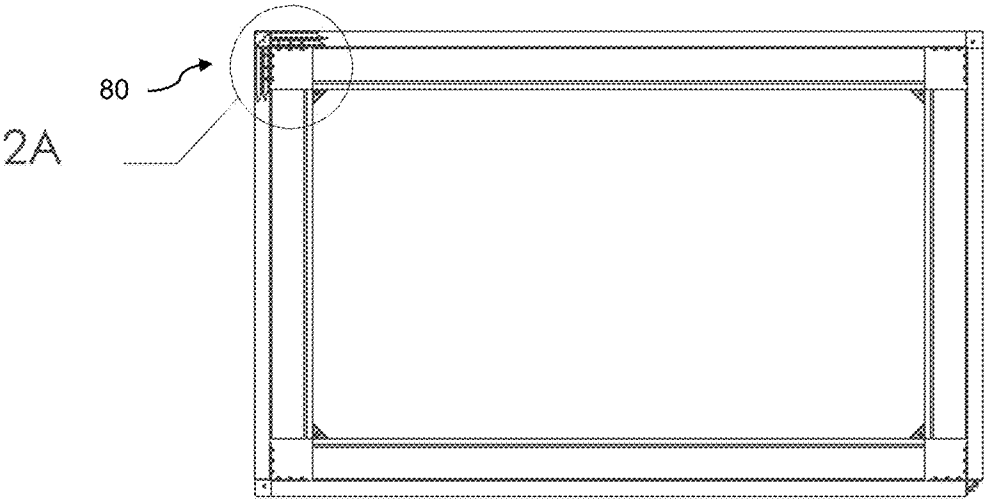
FIG. 2 is a top plan view of the pergola shown in FIG. 1.
Figure 2A:
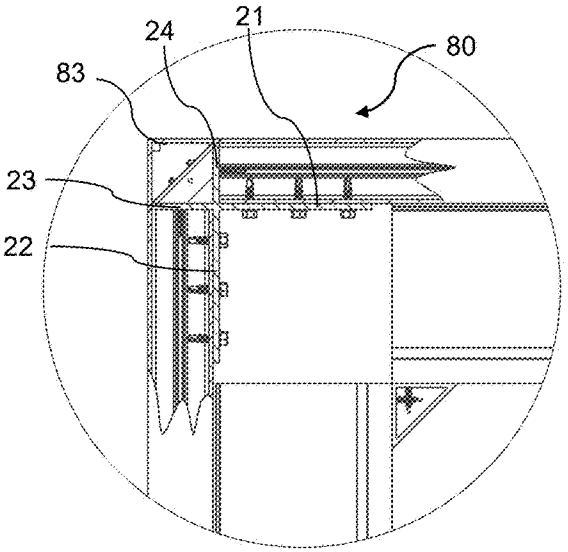
FIG. 2A is an enlarged break-away view of section 2A taken in FIG. 2.
Figure 1A:
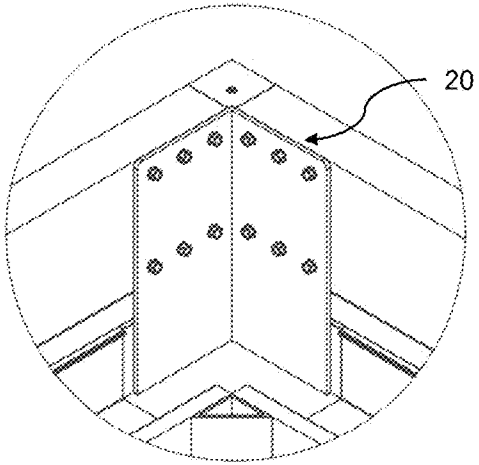
FIG. 1A is an enlarged view of section 1A taken in FIG. 1.
Figure 1B:
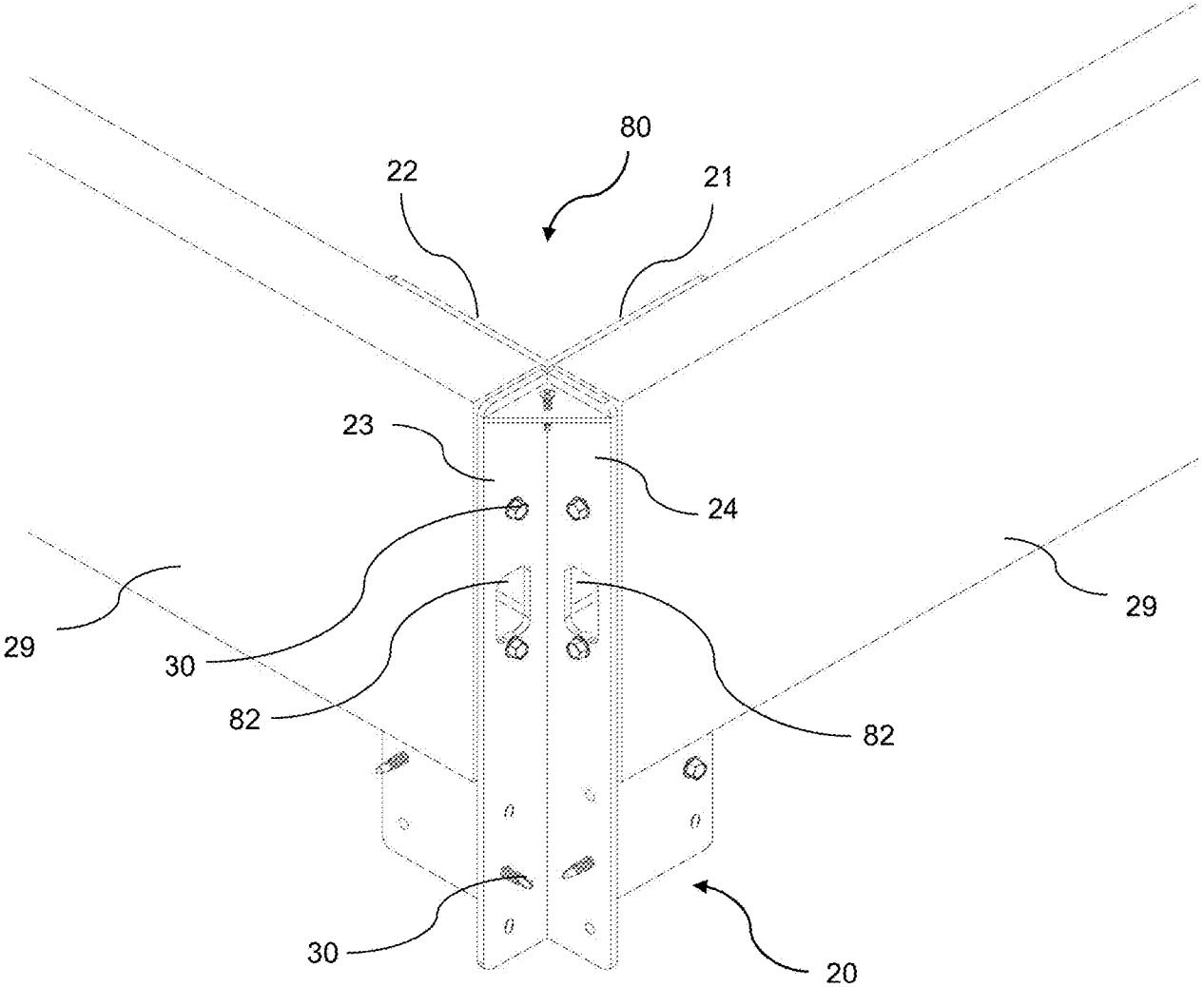
FIG. 1B is an enlarged view of section 1B taken in FIG. 1, showing exposed wire chase apertures.
Figure 4:
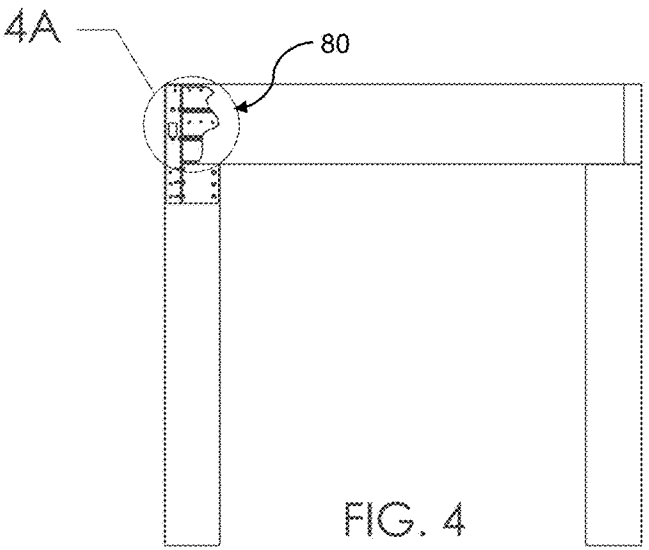
FIG. 4 is a front elevational break-away view of a portion of a pergola corner bracket assembly shown in FIG. 1.
Figure 4A:
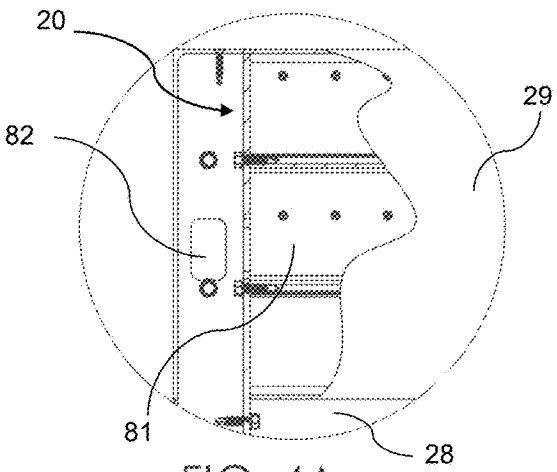
FIG. 4A is an enlarged view of section 4A taken in FIG. 4.
Figure 3:
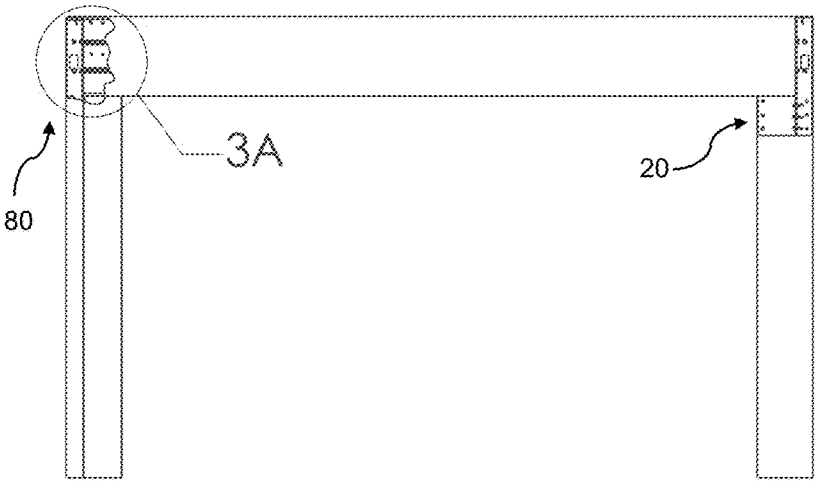
FIG. 3 is a side elevational break-away view of a portion of a pergola corner bracket assembly shown in FIG. 1.
Figure 3A:
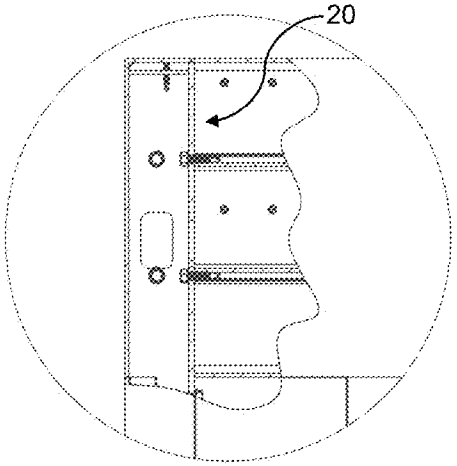
FIG. 3A is an enlarged view of section 3A taken in FIG. 3.
Figure 7:
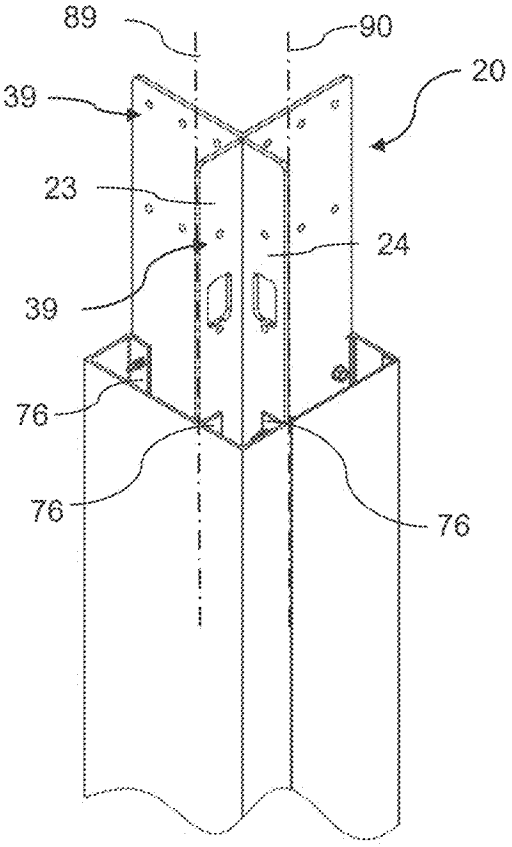
FIG. 7 is another perspective view, of FIG. 6, showing the bracket partially seated within the pergola beam.
Figure 6:
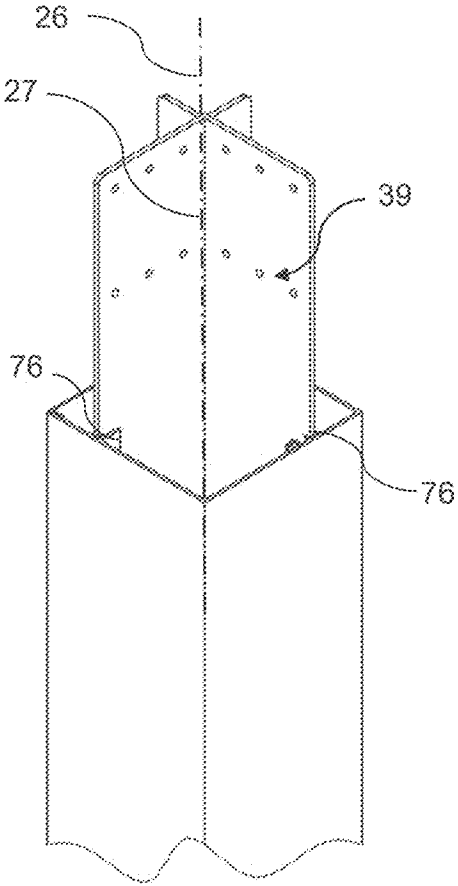
FIG. 6 is a perspective view showing a bracket partially seated within a pergola beam.
Figure 5:
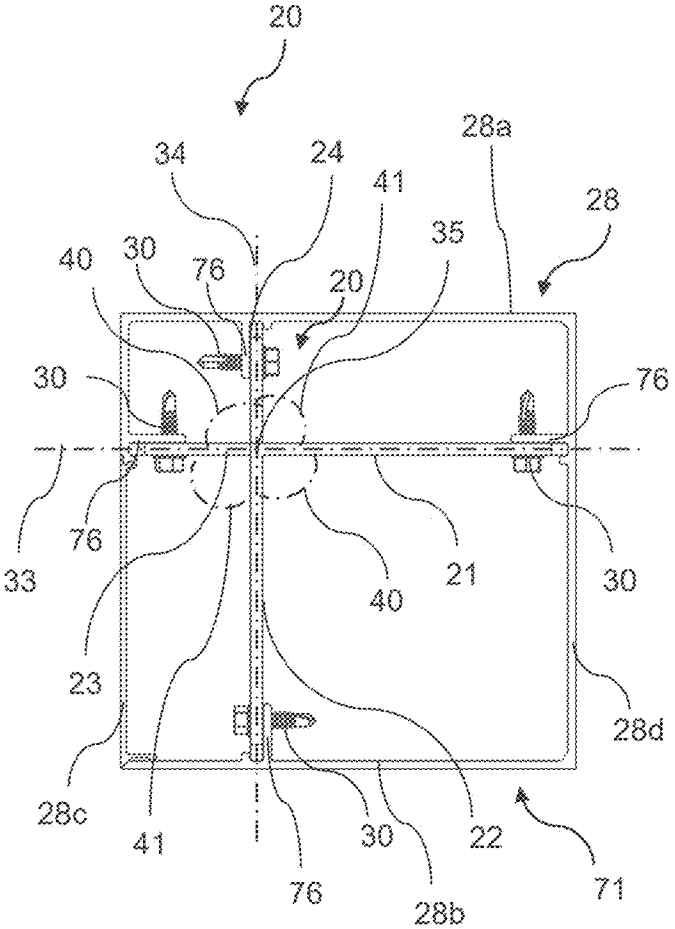
FIG. 5 is a bottom plan view of a bracket anchored to interior walls of a pergola beam.
Figure 11:
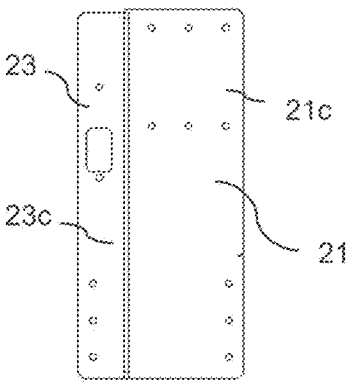
FIG. 11 is a right side elevational view of the bracket shown in FIG. 8.
Figure 10:
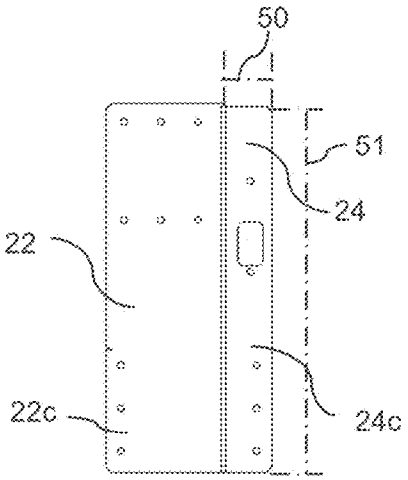
FIG. 10 is a left side elevational view of the bracket shown in FIG. 8.
Figure 9:
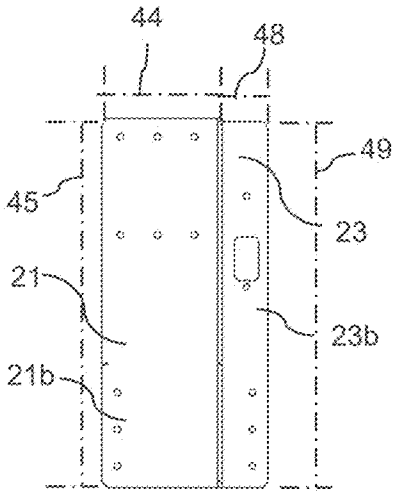
FIG. 9 is a rear elevational view of the bracket shown in FIG. 8.
Figure 8:
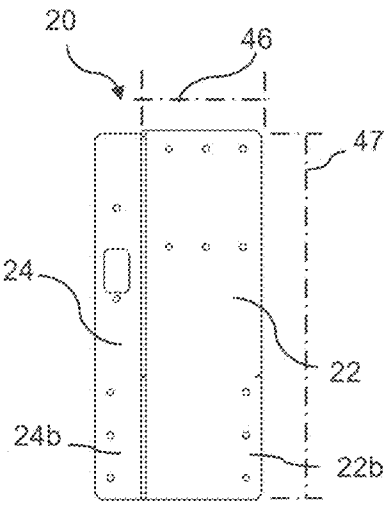
FIG. 8 is a front elevational view of the bracket shown in FIG. 1.
Figure 16:
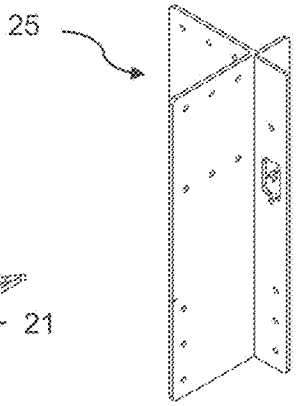
FIG. 16 is yet another perspective view of the bracket shown in FIG. 8.
Figure 15:
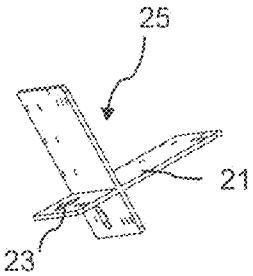
FIG. 15 is another perspective view of the bracket shown in FIG. 8.
Figure 14:
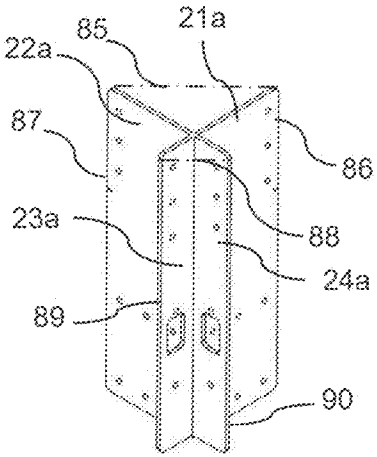
FIG. 14 is a perspective view of the bracket shown in FIG. 8.
Figure 13:
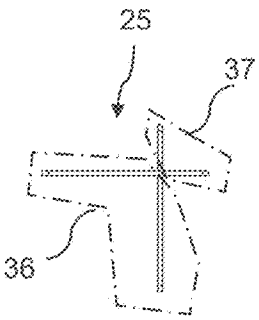
FIG. 13 is a bottom plan view of the bracket shown in FIG. 9.
Figure 12:
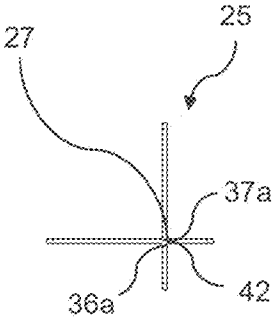
FIG. 12 is a top plan view of the bracket shown in FIG. 9.

The non-limiting exemplary embodiment(s) is/are referred to generally in FIGS. 1-16 and is/are intended to provide a pergola corner bracket assembly 80 including a bracket 20 having a first flange 21 and a second flange 22 registered orthogonal thereto, and a third flange 23 and a fourth flange 24 registered orthogonal thereto. Advantageously, the first flange 21, the second flange 22, the third flange 23, and the fourth flange 24 are arranged in an X-shaped configuration 25. The X-shaped configuration 25 has a longitudinal axis 26 aligned parallel to a shared corner 27 of the first flange 21 and the second flange 22. Notably, each of the third flange 23 and the fourth flange 24 are disposed next to the shared corner 27. Such a structural configuration yields the new, useful, and unpredicted result of: self-aligning a pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, referring to FIGS. 1-16, a bracket 20 is fastened within the column 28, such that flanges of the bracket 20 bears much of the structural load requiring fewer fasteners 30. The pergola corner bracket assembly 80 is also self-aligning, which makes installation easier and hides fasteners 30 from visible exterior surfaces of the pergola. The pergola corner bracket assembly 80 also allows its beams 29 to be used as wire chases and the structural configuration allows the column 28 to be internally plumbed for water drainage. Advantageously, the structural configuration of the pergola corner bracket assembly 80 sits the load bearing beams 29 on top of the column 28 which allows for larger spans and fewer columns 28 because the beam load is shared by the column 28 and fasteners 30 rather than just the fasteners 30. Having the corner bracket 20 within the column 28 yields the unpredicted and unexpected benefit of not requiring the fasteners 30 to absorb the wind shear load (transfers the shear load to the column 28), thereby making possible larger dimensioned pergolas.

In a non-limiting exemplary embodiment, the X-shaped configuration 25 includes two axes of asymmetry including a horizontal axis 33 aligned along and parallel to the first flange 21 and the third flange 23. A vertical axis 34 is aligned along and parallel to the second flange 22 and the fourth flange 24. Advantageously, the vertical axis 34 passes through a centrally offset point 35 (located at the shared corner 27) of the horizontal axis 33. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the X-shaped configuration 25 includes a first V-shaped portion 36 and a second V-shaped portion 37 being unequal thereto. Advantageously, the first V-shaped portion 36 and the second V-shaped portion 37 each have an associated apex **36*a*, 37*a* disposed at the shared corner 27. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28** to be internally plumbed for water drainage.

In a non-limiting exemplary embodiment, the pergola corner bracket assembly 80 further includes a plurality of fasteners 30 affixed to the bracket 20. Such a bracket 20 further has a plurality of holes 39 configured to receive therethrough selected ones of the fasteners 30. Advantageously, such fasteners 30 are not visible from an external line of sight of the pergola corner bracket assembly 80. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the bracket 20 further has two pairs of opposing angles 40-41 that are substantially equal. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, a center 42 of the X-shaped configuration 25 is located at the shared corner 27 of the first flange 21 and the second flange 22. Such an X-shaped configuration 25 has a longitudinal axis 26 aligned parallel to associated medial longitudinal edges 89, 90 of the third flange 23 and the fourth flange 24, respectively. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the first flange 21 has a first latitudinal width 44 and a first longitudinal length 45 substantially equal to a second latitudinal width 46 and a second longitudinal length 47 of the second flange 22. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the third flange 23 has a third latitudinal width 48 and a third longitudinal length 49 substantially equal to a fourth latitudinal width 50 and a fourth longitudinal length 51 of the fourth flange 24. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the first flange 21 is coextensively shaped to the second flange 22. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the third flange 23 is coextensively shaped to the fourth flange 24. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, each of the first flange 21, the second flange 22, the third flange 23, and the fourth flange 24 has a substantially equal longitudinal length 45, 47, 49, 51, respectively. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, each of the first flange 21, the second flange 22, the third flange 23, and the fourth flange 24 has a single and unitary layer 21*a*-24*a* provided with a planar anterior side 21*b*-24*b* and a planar posterior side 21*c*-24*c*, respectively. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the pergola corner bracket assembly 80 further includes a column 28 including four sides 28*a*-28*d* arranged to have a generally square cross-sectional shape 71. Each of the first flange 21 and the third flange 23 is oriented substantially parallel to a first one 28*a* and a second one 28*b* of the four sides 28*a*-28*d* as well as oriented substantially perpendicular to a third one 28*c* and a fourth one 28*d* of the four sides 28*a*-28*d*. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the pergola corner bracket assembly 80 further includes a column 28 having a plurality of interior walls 76. Advantageously, the bracket 20 is fastened to the interior walls 76 within the column 28. Advantageously, the bracket 20 is configured such that the first flange 21, the second flange 22, the third flange 23, and the fourth flange 24 bear most of a structural load of the pergola corner bracket assembly 80. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the pergola corner bracket assembly 80 further includes a column 28 attached to the bracket 20, and a plurality of beams 29 attached to the column 28 and the bracket 20. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the bracket 20 is configured to self-align the beams 29 on the column 28. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, each of the beams 29 has a hollow interior cavity 81. Advantageously, the bracket 20 further includes a plurality of apertures 82 located at the third flange 23 and the fourth flange 24, respectively. Such apertures 82 are in open communication with the hollow interior cavity 81 and configured to use the beams 29 to as wire chases and further configured to internally plumb the column 28 for water drainage. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, a load of each of the beams 29 sits on top of the column 28. In this manner, the bracket 20 is configured to distribute the load directly and solely to the column 28 and the fasteners 30. Advantageously, the bracket 20 is further configured to enable larger pergola spatial dimensions without requiring additional ones of the column 28. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, the pergola corner bracket assembly 80 further includes a corner end cap 83 affixed to the third flange 23 and the fourth flange 24 while remaining spaced from the first flange 21 and the second flange 22. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

In a non-limiting exemplary embodiment, a first rectilinear hypotenuse distance 85 between a first outer longitudinal edge 86 of the first flange 21 and a second outer longitudinal edge 87 of the second flange 22 is greater than a second rectilinear hypotenuse distance 88 between a third outer longitudinal edge 89 of the third flange 23 and a fourth outer longitudinal edge 90 of the fourth flange 24. Such a structural configuration yields the new, useful, and unpredicted result of: self-aligning the pergola column 28 and associated beams 29; reducing and hiding requisite fasteners 30; distributing wind shear loads to the column 28 and fasteners 30; enabling wire chases through adjoining beams 29; and allowing the column 28 to be internally plumbed for water drainage.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A pergola corner bracket assembly comprising:

a bracket having a first flange and a second flange registered orthogonal thereto, and a third flange and a fourth flange registered orthogonal thereto; wherein said first flange, said second flange, said third flange, and said fourth flange are arranged in a X-shaped configuration;

a column having a plurality of sides defining a hollow interior, and a plurality of interior walls extended inwardly from said sides, respectively;

wherein said bracket includes an interior portion and an exposed portion; wherein said interior portion resides within said hollow interior of said column and is fastened to said interior walls; wherein said exposed portion extends out of said column; and a beam attached to one of said first flange and second flange at said exposed portion; wherein said beam is supported by one of said sides of said column that is parallel to one of said first flange and said second flange to which said beam is attached.

2. The pergola corner bracket assembly of claim 1, wherein said X-shaped configuration comprises: two axes of asymmetry including a horizontal axis being aligned along and parallel to said first flange and said third flange; and a vertical axis being aligned along and parallel to said second flange and said fourth flange;

wherein said vertical axis passes through a centrally offset point of said horizontal axis.

3. The pergola corner bracket assembly of claim 1, wherein said X-shaped configuration comprises: a first V-shaped portion and a second V-shaped portion being unequal thereto, wherein said first V-shaped portion and said second V-shaped portion each have an associated apex disposed at said shared corner.

4. The pergola corner bracket assembly of claim 1, further comprising: a plurality of fasteners affixed to said bracket, wherein said bracket further has a plurality of holes configured to receive therethrough selected ones of said fasteners, wherein said fasteners are not visible from an external line of sight of said pergola corner bracket assembly.

5. The pergola corner bracket assembly of claim 1, wherein said bracket further has two pairs of opposing angles that are substantially equal.

6. The pergola corner bracket assembly of claim 1, wherein a center of said X-shaped configuration is located at said shared corner of said first flange and said second flange, said longitudinal axis being aligned parallel to associated medial longitudinal edges of said third flange and said fourth flange, respectively.

7. The pergola corner bracket assembly of claim 1, wherein said first flange has a first latitudinal width and a first longitudinal length substantially equal to a second latitudinal width and a second longitudinal length of said second flange.

8. The pergola corner bracket assembly of claim 1, wherein said third flange has a third latitudinal width and a third longitudinal length substantially equal to a fourth latitudinal width and a fourth longitudinal length of said fourth flange.

9. The pergola corner bracket assembly of claim 1, wherein said first flange is coextensively shaped as said second flange.

10. The pergola corner bracket assembly of claim 1, wherein said third flange is coextensively shaped as said fourth flange.

11. The pergola corner bracket assembly of claim 1, wherein each of said first flange, said second flange, said third flange, and said fourth flange has a substantially equal longitudinal length.

12. The pergola corner bracket assembly of claim 1, wherein each of said first flange, said second flange, said third flange, and said fourth flange has a single and unitary layer provided with a planar anterior side and a planar posterior side, respectively.

13. The pergola corner bracket assembly of claim 1, wherein said column includes four sides arranged to have a generally square cross-sectional shape, wherein each of said first flange and said third flange is oriented substantially parallel to a first one and a second one of said four sides as well as oriented substantially perpendicular to a third one and a fourth one of said four sides.

14. The pergola corner bracket assembly of claim 1, wherein said bracket is configured such that said first flange, said second flange, said third flange, and said fourth flange bear most of a structural load of said pergola corner bracket assembly.

15. The pergola corner bracket assembly of claim 1, wherein said bracket is configured to self-align said beam on said column.

16. The pergola corner bracket assembly of claim 1, wherein said beam has a hollow interior cavity; wherein said bracket further includes a plurality of apertures located at said third flange and said fourth flange, respectively; wherein said apertures are in open communication with said hollow interior cavity and configured to use said beam as a wire chase and further configured to internally plumb said column for water drainage through said hollow interior of said column; wherein said beam sits on said one side of said column, and is configured leave open a portion of said hollow interior of said column.

17. The pergola corner bracket assembly of claim 1, wherein a load of said beam sits on top of said column; wherein said bracket is configured to distribute said load directly and solely to said column and said fasteners; wherein said bracket is further configured to enable larger pergola spatial dimensions without requiring additional ones of said column.

18. The pergola corner bracket assembly of claim 1, wherein said pergola corner bracket assembly further comprises: a corner end cap affixed to said third flange and said fourth flange while remaining spaced from said first flange and said second flange.

19. The pergola corner bracket assembly of claim 1, wherein a first rectilinear hypotenuse distance between a first outer longitudinal edge of said first flange and a second outer longitudinal edge of said second flange is greater than a second rectilinear hypotenuse distance between a third outer longitudinal edge of said third flange and a fourth outer longitudinal edge of said fourth flange.

20. A pergola bracket assembly comprising:

a bracket having a first flange and a second flange registered orthogonal thereto, and a third flange and a fourth flange registered orthogonal thereto;

a column having an interior wall attached to said bracket; and a beam attached to an exposed portion of said bracket;

wherein said first flange, said second flange, said third flange, and said fourth flange are arranged in a X-shaped configuration.

21. A pergola corner bracket assembly comprising:

a column having a generally square cross-sectional shape defined by four sides, wherein an interior surface of said sides includes a plurality of inwardly projecting interior walls;

a bracket comprising a first flange, a second flange, a third flange, and a fourth flange arranged in an X-shaped configuration; wherein said bracket includes an interior portion and an exposed portion; wherein said interior portion resides within said column; wherein each of said first flange, said second flange, said third flange, and said fourth flange is fastened to one of said plurality of inwardly projecting interior walls;

wherein said exposed portion extends out of said column; and a beam attached at said exposed portion to one of said first flange and said second flange of said bracket parallel to said beam; wherein said third flange and said fourth flange have substantially equal latitudinal widths being substantially equal to a latitudinal width of said beam; and wherein an outer side of said beam aligns with an outer side of said column.

22. The pergola corner bracket assembly of claim 1, wherein only said interior portion of said bracket attaches to said interior walls of said column, and no portion of said bracket attaches to an exposed of said column.

23. The pergola corner bracket assembly of claim 1, wherein said first flange, said second flange, said third flange, and said fourth flange are arranged to provide two axes of asymmetry.

24. The pergola corner bracket assembly of claim 1, wherein said beam is a first beam having a first exposed portion attached to one of said first flange and said second flange;

wherein said sides of said column includes a first side and a second side;

wherein said pergola corner bracket assembly further comprises: a second beam having a second exposed portion attached to another of said first flange and second flange;

wherein said second beam is supported by said second side of said column that is parallel to said first flange to which said first beam is attached and orthogonal to said first side of said column supporting said first beam.

25. The pergola bracket assembly of claim 21, wherein said column includes a plurality of sides, said beam being supported by one of said sides of said column that is parallel to one of said first flange and said second flange to which said beam is attached, and said beam being fastened to one of said third flange and fourth flange that is orthogonal to said one of said first flange and said second flange to which said beam is attached.

26. The pergola bracket assembly of claim 21, wherein one of said third flange and said fourth flange being orthogonal to said one of said first flange and said second flange to which said beam is attached and having a latitudinal width that does not exceed a latitudinal width of said beam.

27. The pergola bracket assembly of claim 21, wherein said beam includes four longitudinally coextensive sides.

* * * * *